United States Patent [19]

Schorfheide

[11] 4,354,925

[45] Oct. 19, 1982

[54] CATALYTIC REFORMING PROCESS

[75] Inventor: James J. Schorfheide, Baton Rouge, La.

[73] Assignee: Exxon Research and Engineering Co., Florham Park, N.J.

[21] Appl. No.: 288,318

[22] Filed: Jul. 30, 1981

[51] Int. Cl.[3] ..... B01J 23/90

[52] U.S. Cl. ..... 208/140; 208/65; 252/415; 252/419

[58] Field of Search ..... 208/134, 65, 140; 252/415, 416, 419

[56] References Cited

U.S. PATENT DOCUMENTS

| | | | |
|---|---|---|---|
| 2,758,098 | 8/1956 | Haensel et al. | 252/416 |
| 2,880,161 | 3/1959 | Moore et al. | 208/65 |
| 2,905,622 | 9/1959 | McCarthy | 208/78 |
| 3,020,240 | 2/1962 | Lockett | 208/140 |
| 3,578,608 | 5/1971 | Aykan | 252/411 |
| 4,148,751 | 4/1979 | Hemler et al. | 252/419 |

*Primary Examiner*—Curtis R. Davis

*Attorney, Agent, or Firm*—Llewellyn A. Proctor

[57] ABSTRACT

A process for regenerating, and reactivating, coked noble metal catalysts, especially platinum-containing polymetallic catalysts. A gas is employed for burning coke from the coked catalyst comprising an admixture of from about 0.1 percent to about 10 percent oxygen, and at least about 20 percent carbon dioxide, preferably from about 40 percent to about 99 percent, and more preferably from about 50 percent to about 99 percent carbon dioxide. Regeneration time can be considerably shortened, the frequency of reactor regeneration increased, and compression costs lowered by increasing, or maximizing, the carbon dioxide content of the gas used in the coke burnoff. The higher heat capacity of the carbon dioxide permits the use of a higher oxygen content regeneration gas, particularly during the primary coke burn, as contrasted with the regeneration gas used in conventional catalyst regeneration processes which contain large amounts of nitrogen and flue gas as inert gases.

8 Claims, 2 Drawing Figures

SIMPLIFIED REFORMER REGENERATION SYSTEM

CATALYTIC REFORMING PROCESS

BACKGROUND OF THE INVENTION AND PRIOR ART

Catalytic reforming, or hydroforming, is a well-established industrial process employed by the petroleum industry for improving the octane quality of naphthas or straight run gasolines. In reforming, a multi-functional catalyst is employed which contains a metal hydrogenation-dehydrogenation (hydrogen transfer) component, or components, substantially atomically dispersed upon the surface of a porous, inorganic oxide support, notably alumina. Noble metal catalysts, notably of the platinum type, are currently employed in reforming. Platinum has been widely commercially used in recent years in the production of reforming catalysts, and platinum-on-alumina catalysts have been commercially employed in refineries for the last few decades. In the last decade, additional metallic components have been added to platinum as promoters to further improve the activity or selectivity, or both, of the basic platinum catalyst, e.g., iridium, rhenium, tin, and the like. Reforming is defined as the total effect of the molecular changes, or hydrocarbon reactions, produced by dehydrogenation of cyclohexanes and dehydroisomerization of alkylcyclopentanes to yield aromatics; dehydrogenation of paraffins to yield olefins; dehydrocyclization of paraffins and olefins to yield aromatics; isomerization of normal paraffins; isomerization of alkylcycloparaffins to yield cyclohexanes; isomerization of substituted aromatics; and hydrocracking of paraffins which produces gas, and inevitably coke, the latter being deposited on the catalyst.

In a conventional process, a series of reactors constitute the heart of the reforming unit. Each reforming reactor is generally provided with fixed beds of the catalyst which receive upflow or downflow feed, and each is provided with a heater, because the reactions which take place are endothermic. A naphtha feed, with hydrogen, or hydrogen recycle gas, is concurrently passed through a preheat furnace and reactor, and then in sequence through subsequent interstage heaters and reactors of the series. The product from the last reactor is separated into a liquid fraction, and a vaporous effluent. The latter is a gas rich in hydrogen, and usually contains small amounts of normally gaseous hydrocarbons, from which hydrogen is separated from the $C_5+$ liquid product and recycled to the process to minimize coke production.

The activity of the catalyst gradually declines due to the buildup of coke. Coke formation is believed to result from the deposition of coke precursors such as anthracene, coronene, ovalene and other condensed ring aromatic molecules on the catalyst, these polymerizing to form coke. During operation, the temperature of the process is gradually raised to compensate for the activity loss caused by the coke deposition. Eventually, however, economics dictates the necessity of reactivating the catalyst. Consequently, in all processes of this type the catalyst must necessarily be periodically regenerated by burning the coke off the catalyst at controlled conditions, this constituting an initial phase of catalyst reactivation.

Two major types of reforming are generally practiced in the multi-reactor units, both of which necessitate periodic reactivation of the catalyst, the initial sequence of which requires regeneration, i.e., burning the coke from the catalyst. Reactivation of the catalyst is then completed in a sequence of steps wherein the agglomerated metal hydrogenation-dehydrogenation components are atomically redispersed. In the semi-regenerative process, a process of the first type, the entire unit is operated by gradually and progressively increasing the temperature to maintain the activity of the catalyst caused by the coke deposition, until finally the entire unit is shut down for regeneration, and reactivation, of the catalyst. In the second, or cyclic type of process, the reactors are individually isolated, or in effect swung out of line by various manifolding arrangements, motor operated valving and the like. The catalyst is regenerated to remove the coke deposits, and reactivated while the other reactors of the series remain on stream. A "swing reactor" temporarily replaces a reactor which is removed from the series for regeneration and reactivation of the catalyst, until it is put back in series.

There are several steps required for the regeneration, and reactivation of a catalyst. Typically, regeneration of a catalyst is accomplished in a primary and secondary coke burnoff. This is accomplished, initially, by burning the coke from the catalyst at a relatively low temperature, i.e., at about 800° F.–950° F., by the addition of a gas, usually nitrogen or flue gas, which contains about 0.6 mole percent oxygen. A characteristic of the primary burn is that essentially all of the oxygen is consumed, with essentially no oxygen being contained in the reactor gas outlet. Regeneration is carried out once-through, or by recycle of the gas to the unit. The temperature is gradually raised and maintained at about 950° F. until essentially all of the coke has been burned from the catalyst, and then the oxygen concentration in the gas is increased, generally to about 6 mole percent. The main purpose of the secondary burn is to insure thorough removal of coke from the catalyst within all portions of the reactor. The catalyst is then rejuvenated with chlorine and oxygen, reduced, and then sulfided. Thus, the agglomerated metal, or metals, of the catalyst, is redispersed by contacting the catalyst with a gaseous admixture containing a sufficient amount of a chloride, e.g., carbon tetrachloride, to decompose in situ and deposit about 0.1 to about 1.5 wt.% chloride on the catalyst; continuing to add a gaseous mixture containing about 6% oxygen for a period of 2 to 4 hours while maintaining temperature of about 950° F.; purging with nitrogen to remove essentially all traces of oxygen from the reactor; reducing the metals of the catalyst of contact with a hydrogen-containing gas at about 850° F.; and then sulfiding the catalyst by direct contact with, e.g., a gaseous admixture of n-butyl mercaptan in hydrogen, sufficient to deposit the desired amount of sulfur on the catalyst. The primary coke burnoff step is extremely time-consuming, the primary coke burn frequently accounting for up to one-half of the time a reactor is off-oil for regeneration, and reactivation; and, a major consideration in the regeneration/reactivation sequence relates to the rate at which oxygen can be fed into a reactor. The total heat released is directly proportional to the amount of coke burned, and hence the rate at which oxygen can be fed into the reactor then is governed by the rate at which heat can be removed from a catalyst bed, and reactor, so that the flame front temperature in a bed does not become sufficiently overheated to damage the catalyst. Generally, it is desired that the regeneration temperature not exceed about 950° F. to about 975° F.

It is, accordingly, a primary objective of the present invention to shorten the time required for regeneration of noble metal reforming catalysts, especially platinum-containing reforming catalysts.

A specific object is to provide a novel process for the regeneration of such catalysts, especially as relates to the use of such catalysts in cyclic reforming units, notably one which will shorten the time required for regeneration of such catalysts; this permitting an increase in regeneration frequency so that all reactors can operate at a fresher level of catalyst performance to provide increased overall catalyst activity and increased $C_5$+ liquid yields.

A further, and more specific object is to provide a process which will lower compression costs by reducing the amount of gas that must be compressed and injected into a reforming unit during catalyst regeneration.

These objects and others are achieved in accordance with the present invention, embodying improvements in a process for regenerating, and reactivating, noble metal catalysts, especially platinum-containing polymetallic catalysts, by the use of a gas for burning coke from a coked catalyst comprising an admixture of from about 0.1 percent to about 10 percent oxygen, preferably from about 0.2 percent to about 7 percent oxygen, and more preferably from about 0.2 to about 4 percent oxygen, and at least about 20 percent carbon dioxide, preferably from about 40 percent to about 99 percent, and more preferably from about 50 percent to about 99 percent carbon dioxide, based on the total volume of the regeneration gas. Water, or moisture levels are maintained below about 5 volume percent, preferably below about 2 volume percent during the burn. In accordance with this invention, albeit carbon dioxide does not participate in the reaction to any appreciable extent, if any, it has been found that regeneration time can be considerably shortened, the frequency of reactor regeneration increased, and compression costs lowered by increasing, or maximizing, the carbon dioxide content of the gas used in the coke burnoff, particularly that portion of the regeneration period referred to as the primary coke burnoff. The higher heat capacity of the carbon dioxide permits the use of a greater amount of oxygen in the regeneration gas which is fed to a reactor and contacted with a catalyst, particularly during the primary coke burn, as contrasted with the regeneration gas used in conventional catalyst regeneration processes which contain large amounts of nitrogen and flue gas as inert gases.

Over a temperature range of 800° F. to 980° F., e.g., carbon dioxide has an average heat capacity 63 percent greater than that of nitrogen (12.1 Btu/lb mole −°F. for $CO_2$ versus 7.43 Btu/lb mole −°F. for nitrogen). Therefore, for a reactor inlet gas temperature of about 750°–800° F. and a flame front temperature of about 950°–975° F., carbon dioxide will absorb roughly 63 percent more heat than an equivalent volume of nitrogen at corresponding temperatures. For the two extreme cases where the non-oxygen portion of the oxygen-containing gas which is fed to the reactor in which the coke is being burned consists almost entirely of either carbon dioxide, or of nitrogen, the concentration of oxygen at the reactor inlet can be about 63 percent greater in the case of complete carbon dioxide. This can reduce that the total catalyst burn time by nearly 40 percent. It is found that the substitution of carbon dioxide for flue gas in a conventional catalyst regeneration gas can achieve a 25 percent reduction in the time required for the primary burn. The further substitution of oxygen for air in addition to the substitution of carbon dioxide for flue gas can provide a full 33 percent reduction in primary burn time. In each case, compression costs are lowered because of the reduced volume of gas involved per pound of coke burned.

Average catalyst activities, and overall $C_5$+ liquid yields are improved, especially in regenerating the catalyst in cyclic reforming units, vis-a-vis the regeneration of catalysts in conventional regeneration units, by maximizing the carbon dioxide content (specifically, the $CO_2/NO_2$ ratio) of the gas circulation system during the coke burnoff phases of catalyst regeneration, particularly during the primary burn. The higher heat capacity of carbon dioxide permits a higher concentration of oxygen in the regeneration gas which is fed to the reactor. Regeneration times are consequently shortened and the frequency of reactor regeneration is increased. Catalyst activity and yields are improved. In addition, compression costs are lower than those of conventional nitrogen or flue gas regeneration systems.

These features and others will be better understood by reference to the following more detailed description of the invention, and to the drawings to which reference is made.

Figure 1:
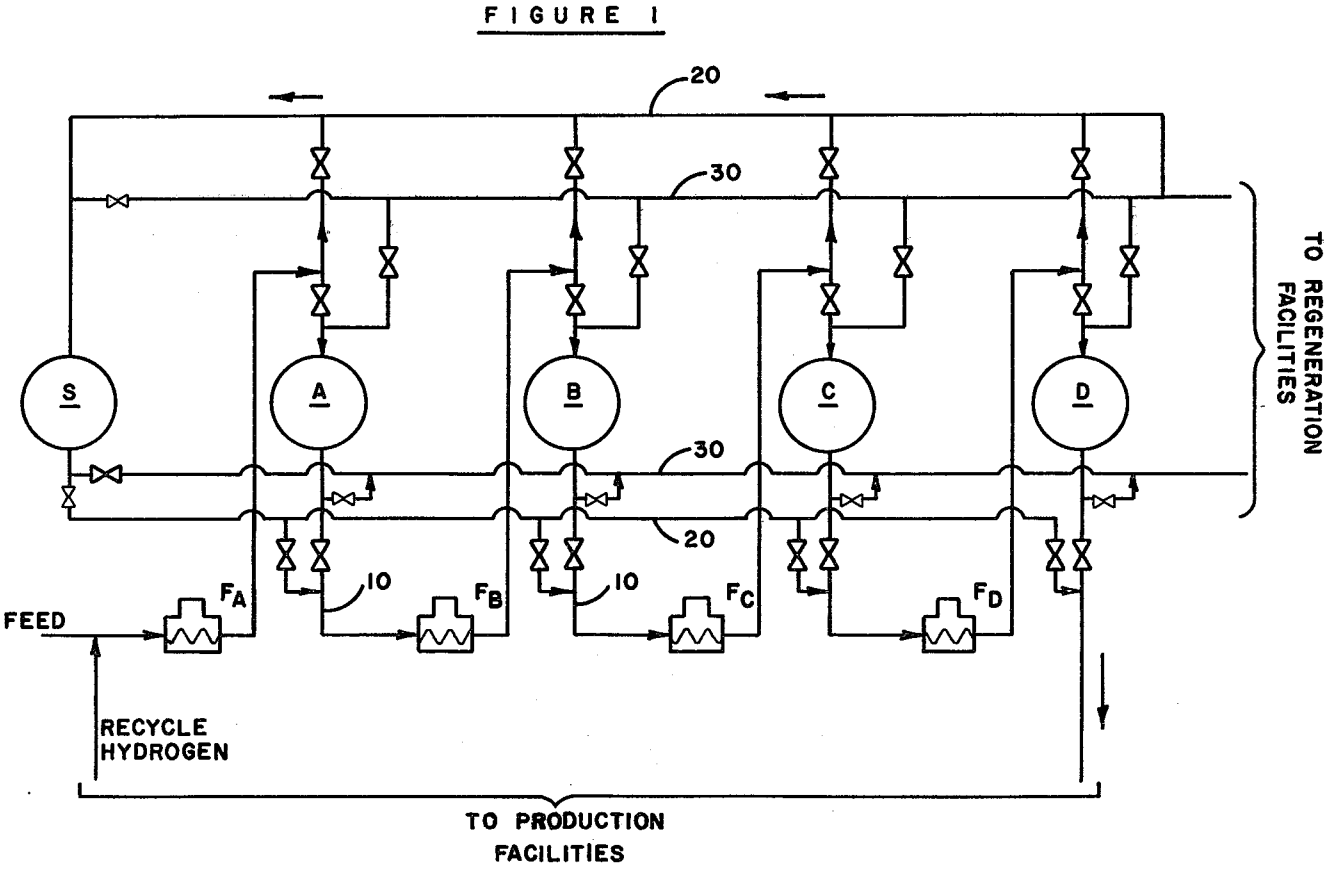
FIG. 1 depicts, by means of a simplified flow diagram, a preferred cyclic reforming unit inclusive of multiple on-steam reactors, and an alternate or swing reactor inclusive of manifolds for use with catalyst regeneration and reactivation equipment (not shown).

Referring generally to FIG. 1, there is described a cyclic unit comprised of a multi-reactor system, inclusive of on-stream Reactors A, B, C, D and a swing Reactor S, and a manifold useful with a facility for periodic regeneration and reactivation of the catalyst of any given reactor, swing Reactor S being manifolded to Reactors A, B, C, D so that it can serve as a substitute reactor for purposes of regeneration and reactivation of the catalyst of a reactor taken off-stream. The several reactors of the series A, B, C, D, are arranged so that while one reactor is off-stream for regeneration and reactivation of the catalyst, the swing Reactor S can replace it and provision is also made for regeneration and reactivation of the catalyst of the swing reactor.

In particular, the on-stream Reactors A, B, C, D, each of which is provided with a separate furnace or heater $F_A$, or reheater $F_B$, $F_C$, $F_D$, respectively, are connected in series via an arrangement of connecting process piping and valves so that feed can be passed in seriatim through $F_A$A, $F_B$B, $F_C$C, $F_D$D, respectively; or generally similar grouping wherein any of Reactors A, B, C, D are replaced by Reactor S. This arrangement of piping and valves is designated by the numeral 10. Any one of the on-stream Reactors A, B, C, D, respectively, can be substituted by swing Reactor S as when the catalyst of any one of the former requires regeneration and reactivation. This is accomplished in "paralleling" the swing reactor with the reactor to be removed from the circuit for regeneration by opening the valves on each side of a given reactor which connect to the upper and lower lines of swing header 20, and then closing off the valves in line 10 on both sides of said reactor so that fluid enters and exits from said swing Reactor S. Regeneration facilities, not shown, are manifolded to each of the several Reactors A, B, C, D, S through a parallel circuit of connecting piping and valves which form the upper and lower lines of regeneration header 30, and any one of the several reactors can be individually isolated from reactivated.

lute and relative terms. The recycle and inert gas makeup rates per 100 scf of air or 21 scf of oxygen, which are required to maintain the oxygen and water concentrations shown in columns three and six, are give in columns ten and eleven. The ninth column compares the reduction of primary coke burnoff time with an air/flue gas standard.

TABLE I

| Description of Process | | | Recycle Gas Composition, mole (volume) percent[a] | | | Vapor Heat Capacity[b] | | Reduction | Gas Requirements per 100 scf air or 21 scf $O_2$ | | Reduction in Recycle |
|---|---|---|---|---|---|---|---|---|---|---|---|
| Oxygen Source | Inert Gas Makeup | $O_2$ at Reactor Inlet | $CO_2$ | $N_2$ | $H_2O$ | Btu/1000 scf-°F. | Relative | in Primary Burn Time | Recycle Compression | Inert Gas Makeup | Gas Requirements |
| Air | Dry Flue Gas (11.7% $CO_2$, 88.3% $N_2$) | 0.6% | 13.9 | 84.6 | 1.5 | 21.8 | Base = 100 | 0 | 3400 scf | 190 scf | |
| Air | $CO_2$ | 0.6 | 73.0 | 25.5 | 1.5 | 28.7 | 134 | | 3400 scf | 190 scf | |
| Air | $CO_2$ | 0.8 | 73.0 | 25.5 | 1.5 | " | 134 | 25% | 2525 scf | 185 scf | 26% |
| $O_2$ | $CO_2$ | 0.6 | 98.5 | 0 | 1.5 | 31.9 | 149 | | 3479 scf | 264 scf | |
| $O_2$ | $CO_2$ | 0.9 | 98.5 | 0 | 1.5 | " | 149 | 33% | 2312 scf | 254 scf | 32% |

[a]Based on a recycle stream water content of 1.5 volume percent. Coke on catalyst assumed to be $CH_{0.5}$ and combustion products $CO_2$ and $H_2O$.
[b]The absolute heat capacity values shown are those of a typical mean catalyst bed temperature. The relative values shown encompass a broad range of conditions and are not restricted to a specific temperature.

In conventional practice the reactor regeneration sequence is practiced in the order which will optimize the efficiency of the catalyst based on a consideration of the amount of coke deposited on the catalyst of the different reactors during the operation. Coke deposits much more rapidly on the catalyst of Reactors C, D and S than on the catalyst of Reactors A and B and, accordingly, the catalysts of the former are regenerated and reactivated at greater frequency than the latter. The reactor regeneration sequence is characteristically in the order ACDS/BCDS, i.e., Reactors A, C, D, B, etc., respectively, are substituted in order by another reactor, typically swing Reactor S, and the catalyst thereof regenerated and reactivated while the other four reactors are left on-stream.

Figure 2:
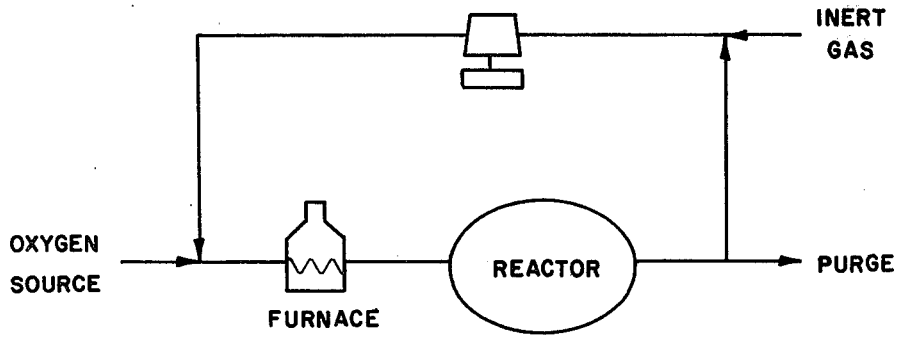
FIG. 2 depicts, in schematic fashion, for convenience, a simplified regeneration circuit.

FIG. 2, as suggested, presents a simplified schematic diagram of one type of reformer regeneration circuit. The concentration of oxygen at the reactor inlet is typically maintained at 0.6 mole percent during the primary burn. The concentration of water in the recycle gas, via the use of a recycle gas drier (not shown) or an adequate flow of a purge stream is generally held below about 1.5 mole percent in order to avoid damage to the catalyst. Nitrogen or flue gas, typically used as the inert gas makeup to the recycle gas stream, is in accordance with this invention replaced by carbon dioxide.

The invention, and its principle of operation, will be more fully understood by reference to the following examples, and comparative data, which illustrates the invention.

The data given in Table I represents a comparison of (a) dry gases constituted of air and flue gas employed as catalyst regeneration gases and (b) dry gases constituted of air or oxygen and carbon dioxide employed as catalyst regeneration gases. The first column of the table lists the oxygen source, the second column lists the inert gas source and the third column gives the amount of molecular oxygen contained in the mixture. Columns four and five list the amount of carbon dioxide and nitrogen, if any, respectively, contained in the gaseous mixtures. Column six shows that all comparison in the table are based on the limitation that the concentration of water in the recycle gas is not permitted to exceed 1.5 volume percent as regulated by a purge gas stream, as shown in FIG. 2. Columns seven and eight list the vapor heat capacity of each gaseous admixture, in abso- As shown, and earlier suggested, the substitution of carbon dioxide for flue gas provides a 25 percent reduction in the time required for the primary burn, and the further substitution of oxygen for air provides a 33 percent reduction in the time required for the primary burn. Column twelve gives the reduction of volume of recycle gas which must be compressed in the system described by reference to FIG. 2.

Large quantities of high-purity carbon dioxide are available as a byproduct of steam-reforming hydrogen plants, and ammonia manufacturing plants.

Because of the large amounts of carbon dioxide which would be present in the regeneration gas, some carbon monoxide may form during regeneration via the reaction $$C + CO_2 \rightleftarrows 2CO$$

This would occur downstream of the regeneration flame front. Table II shows the maximum (equilibrium) amounts of carbon monoxide which can exist at 950° F. and 200 psig, viz. up to 1.4 volume percent carbon monoxide in a conventional flue gas regeneration system. The upper level of carbon monoxide which could exist if carbon dioxide were substituted for flue gas is about 3 volume percent. These levels of carbon monoxide are not found to be harmful to the catalyst during coke burnoff, and subsequent catalyst treatment steps such as reduction and sulfidation are not affected because of intermediate reactor purges and depressurizations.

TABLE II

MAXIMUM ATTAINABLE CO LEVELS

| Description of Process | | | Composition at Reactor Outlet Assuming Equilibrium Conversion of $CO_2$ to CO (950° F., 200 psig)[a] | | | |
|---|---|---|---|---|---|---|
| Oxygen Source | Inert Gas Makeup | $O_2$ at Reactor Inlet | $CO_2$ | CO | $H_2O$ | $N_2$ |
| Air | Dry Flue Gas (11.7 $CO_2$, 88.3% $N_2$) | 0.6% | 13.3% | 1.3% | 1.6% | 83.8% |
| Air | $CO_2$ | 0.8 | 70.5 | 2.9 | 1.5 | 25.1 |

TABLE II-continued

MAXIMUM ATTAINABLE CO LEVELS

| Description of Process | | | Composition at Reactor Outlet Assuming Equilibrium Conversion of $CO_2$ to CO (950° F., 200 psig)[a] | | | |
|---|---|---|---|---|---|---|
| Oxygen Source | Inert Gas Makeup | $O_2$ at Reactor Inlet | $CO_2$ | CO | $H_2O$ | $N_2$ |
| $O_2$ | $CO_2$ | 0.9 | 95.1 | 3.4 | 1.5 | 0 |

[a]Based on $K_p$ ($P_{CO}/P_{CO2}$) = 58 $atm^{-1}$ at 950° F.

The value of the increased $C_5$+ liquid yields which can be achieved by the method of this invention are significant, e.g., 10–20 per barrel of feed based on a computer model simulation of a unit constituted of four reactors, plus a swing reactor using an Arabian paraffinic naphtha feed at 950° F. Equivalent Isothermal Temperature, 215 psig inlet pressure, and 3000 scf/B recycle rate, with a $C_5$+ yield of 72 LV% at 102 RON. Calculations show an estimated 0.5 LV% $C_5$+ yield increase if the predicted 30-hour regeneration time is reduced by 5 hours. These yields result from the higher catalyst activities which are achieved by shorter regeneration times. Although particularly applicable to cyclic reforming systems, the process of the invention is especially useful in high-severity reforming systems (for example, high octane, low pressure, or low recycle operations), where the incentives for increased regeneration frequencies are the greatest. Additional credits are gained because of the lower recycle (gas compression) requirements per pound of coke burned, and shortened regeneration periods. These effects are compounded by the shortened regeneration periods which increase the regeneration frequency and further shorten regeneration periods because of the smaller amounts of coke which form between regenerations.

The catalysts employed in accordance with this invention are constituted of composite particles which contain, besides a carrier or support material, a noble metal hydrogenation-dehydrogenation component, or components, a halide component and, preferably, the catalyst is sulfided. The catalyst contains a Group VIII noble metal, or platinum group metal (ruthenium, rhodium, palladium, osmium, iridium and platinum); and suitably an additional metal or metals component, e.g., rhenium, iridium, tin, germanium, tungsten, or the like. The support material is constituted of a porous, refractory inorganic oxide, particularly alumina. The support can contain, e.g., one or more of alumina, bentonite, clay, diatomaceous earth, zeolite, silica, activated carbon, magnesia, zirconia, thoria, and the like; though the most preferred support is alumina to which, if desired, can be added a suitable amount of other refractory carrier materials such as silica, zirconia, magnesia, titania, etc., usually in a range of about 1 to 20 percent, based on the weight of the support. A preferred support for the practice of the present invention is one having a surface area of more than 50 $m^2/g$, preferably from about 100 to about 300 $m^2/g$, a bulk density of about 0.3 to 1.0 g/ml, preferably about 0.4 to 0.8 g/ml, an average pore volume of about 0.2 to 1.1 ml/g, preferably about 0.3 to 0.8 ml/g, and an average pore diameter of about 30° to 300° A.

The metal hydrogenation-dehydrogenation component can be composited with or otherwise intimately associated with the porous inorganic oxide support or carrier by various techniques known to the art such as ion-exchange, coprecipitation with the alumina in the sol or gel form, and the like. For example, the catalyst composite can be formed by adding together suitable reagents such as a salt of platinum and ammonium hydroxide or carbonate, and a salt of aluminum such as aluminum chloride or aluminum sulfate to form aluminum hydroxide. The aluminum hydroxide containing the salts of platinum can then be heated, dried, formed into pellets or extruded, and then calcined in nitrogen or other non-agglomerating atmosphere. The metal hydrogenationn components can also be added to the catalyst by impregnation, typically via an "incipient wetness" technique which requires a minimum of solution so that the total solution is absorbed, initially or after some evaporation.

It is preferred to deposit the platinum and additional metals used as promoters, if any, on a previously pilled, pelleted, beaded, extruded, or sieved particulate support material by the impregnation method. Pursuant to the impregnation method, porous refractory inorganic oxides in dry or solvated state are contacted, either alone or admixed, or otherwise incorporated with a metal or metals-containing solution, or solutions, and thereby impregnated by either the "incipient wetness" technique, or a technique embodying absorption from a dilute or concentrated solution, or solutions, with subsequent filtration or evaporation to effect a total uptake of the metallic components.

Platinum in absolute amount, is usually supported on the carrier within the range of from about 0.01 to 3 percent, preferably from about 0.05 to 1 percent, based on the weight of the catalyst (dry basis). The absolute concentration of the metal, of course, is preselected to provide the desired catalyst for each respective reactor of the unit. In compositing the metal, or metals, with the carrier, essentially any soluble compound can be used, but a soluble compound which can be easily subjected to thermal decomposition and reduction is preferred, for example, inorganic salts such as halide, nitrate, inorganic complex compounds, or organic salts such as the complex salt of acetylacetone, amine salt, and the like. Where, e.g., platinum is to be deposited on the carrier, platinum chloride, platinum nitrate, chloroplatinic acid, ammonium chloroplatinate, potassium chloroplatinate, platinum polyamine, platinum acetylacetonate, and the like, are preferably used. A promoter metal, when employed, is added in concentration ranging from about 0.01 to 3 percent, preferably from about 0.05 to about 1 percent, based on the weight of the catalyst.

To enhance catalyst performance in reforming operations, it is also required to add a halogen component to the catalysts, fluorine and chlorine being preferred halogen components. The halogen is contained on the catalyst within the range of 0.1 to 3 percent, preferably within the range of about 1 to about 1.5 percent, based on the weight of the catalyst. When using chlorine as a halogen component, it is added to the catalyst within the range of about 0.2 to 2 percent, preferably within the range of about 1 to 1.5 percent, based on the weight of the catalyst. The introduction of halogen into catalyst can be carried out by any method at any time. It can be added to the catalyst during catalyst preparation, for example, prior to, following or simultaneously with the incorporation of the metal hydrogenation-dehydrogenation component, or components. It can also be introduced by contacting a carrier material in a vapor phase or liquid phase with a halogen compound such as hydrogen fluoride, hydrogen chloride, ammonium chloride, or the like.

The catalyst is dried by heating at a temperature above about 80° F., preferably between about 150° F. and 300° F., in the presence of nitrogen or oxygen, or both, in an air stream or under vacuum. The catalyst is calcined at a temperature between about 500° F. to 1200° F., preferably about 500° F. to 1000° F., either in the presence of oxygen in an air stream or in the presence of an inert gas such as nitrogen.

Sulfur is a highly preferred component of the catalysts, the sulfur content of the catalyst generally ranging to about 0.2 percent, preferably from about 0.05 percent to about 0.15 percent, based on the weight of the catalyst (dry basis). The sulfur can be added to the catalyst by conventional methods, suitably by breakthrough sulfiding of a bed of the catalyst with a sulfur-containing gaseous stream, e.g., hydrogen sulfide in hydrogen, performed at temperatures ranging from about 350° F. to about 1050° F. and at pressures ranging from about 1 to about 40 atmospheres for the time necessary to achieve breakthrough, or the desired sulfur level.

An isolated reactor which contains a bed of such catalyst, the latter having reached an objectionable degree of deactivation due to coke deposition thereon, is first purged of hydrocarbon vapors with a non-reactive or inert gas, e.g., helium, nitrogen, or flue gas. The coke or carbonaceous deposits are then burned from the catalyst in a primary burn by contact with a $CO_2$ rich oxygen-containing gas, particularly one rich in both oxygen and $CO_2$, at controlled temperature below about 1100° F., and preferably below about 1000° F. The temperature of the burn is controlled by controlling the oxygen concentration and inlet gas temperature, this taking into consideration, of course, the amount of coke to be burned and the time desired in order to complete the burn. Typically, the catalyst is initially treated with an oxygen/carbon dioxide gas having an oxygen partial pressure of at least about 0.1 psi (pounds per square inch), and preferably in the range of about 0.2 psi to about 5 psi to provide a temperature of no more than about 950° F. to about 1000° F., for a time sufficient to remove the coke deposits. Coke burn-off is thus accomplished by first introducing only enough oxygen to initiate the burn while maintaining a relatively low temperature, and then gradually increasing the temperature as the flame front is advanced by additional oxygen injection until the temperature has reached optimum. Suitably, the oxygen is increased within the mixture to about 6 volume percent and the temperature gradually elevated to about 950° F.

Typically in reactivating multimetallic catalysts, sequential halogenation and hydrogen reduction treatments are required to reactivate the reforming catalysts to their original state of activity, or activity approaching that of fresh catalyst after coke or carbonaceous deposits have been removed from the catalyst. The agglomerated metals of the catalyst are first redispersed and the catalyst reactivated by contact of the catalyst with halogen, suitably a halogen gas or a substance which will decompose in situ to generate halogen. Various procedures are available dependent to a large extent on the nature of the catalyst employed. Typically, e.g., in the reactivation of a platinum-rhenium catalyst, the halogenation step is carried out by injecting halogen, e.g., chlorine, bromine, fluorine or iodine, or a halogen component which will decompose in situ and liberate halogen, e.g., carbon tetrachloride, in the desired quantities, into the reaction zone. The gas is generally introduced as halogen, or halogen-containing gaseous mixture, into the reforming zone and into contact with the catalyst at temperature ranging from about 550° F. to about 1150° F., and preferably from about 700° F. to about 1000° F. The introduction may be continued up to the point of halogen breakthrough, or point in time when halogen is emitted from the bed downstream of the locationn of entry where the halogen gas is introduced. The concentration of halogen is not critical, and can range, e.g., from a few parts per million (ppm) to essentially pure halogen gas. Suitably, the halogen, e.g., chlorine, is introduced in a gaseous mixture wherein the halogen is contained in concentration ranging from about 0.01 mole percent to about 10 mole percent, and preferably from about 0.1 mole percent to about 3 mole percent.

After redispersing the metals with the halogen treatment, the catalyst may then be rejuvenated by soaking in an admixture of air which contains about 6 to 20 volume percent oxygen, at temperatures ranging from about 850° F. to about 950° F.

Oxygen is then purged from the reaction zone by introduction of a nonreactive or inert gas, e.g., nitrogen, helium or flue gas, to eliminate the hazard of a chance explosive combination of hydrogen and oxygen. A reducing gas, preferably hydrogen or a hydrogen-containing gas generated in situ or ex situ, is then introduced into the reaction zone and contacted with the catalyst at temperatures ranging from about 400° F. to about 1100° F., and preferably from about 650° F. to about 950° F., to effect reduction of the metal hydrogenation-dehydrogenation components, contained on the catalysts. Pressures are not critical, but typically range between about 5 psig to about 300 psig. Suitably, the gas employed comprises from about 0.5 to about 50 percent hydrogen, with the balance of the gas being substantially nonreactive or inert. Pure, or essentially pure, hydrogen is, of course, suitable but is quite expensive and therefore need not be used. The concentration of the hydrogen in the treating gas and the necessary duration of such treatment, and temperature of treatment, are interrelated, but generally the time of treating the catalyst with a gaseous mixture such as described ranges from about 0.1 hour to about 48 hours, and preferably from about 0.5 hour to about 24 hours, at the more preferred temperatures.

The catalyst of a reactor may be presulfided, prior to return of the reactor to service. Suitably a carrier gas, e.g., nitrogen, hydrogen, or admixture thereof, containing from about 500 to about 2000 ppm of hydrogen sulfide, or compound, e.g., a mercaptan, which will decompose in situ to form hydrogen sulfide, at from about 700° F. to about 950° F., is contacted with the catalyst for a time sufficient to incorporate the desired amount of sulfur upon the catalyst.

It is apparent that various modifications and changes can be made without departing from the spirit and scope of the present invention, the outstanding feature of which is that the octane quality of various hydrocarbon feedstocks, inclusive particularly of paraffinic feedstocks, can be upgraded and improved.

Having described the invention, what is claimed is:

1. In a process for reforming, with hydrogen, a naphtha feed which is contacted at reforming conditions in a reforming unit constituted of one or more on-stream reactors connected in series, each of which contains a noble metal catalyst which is deactivated by coke which is deposited on the catalyst, the improvement comprising burning the coke from the catalyst by the use of a gas comprising an admixture of from about 0.1 percent to about 10 percent oxygen, and at least about 20 percent carbon dioxide, based on the total volume of the gas.

2. The process of claim 1 wherein the coke is burned from the catalyst by the use of a gas comprising an admixture of from about 0.2 percent to about 7 percent oxygen and at least about 40 percent carbon dioxide.

3. The process of claim 1 wherein the coke is burned from the catalyst by the use of a gas comprising an admixture of from about 0.2 percent to about 4 percent oxygen and from about 50 percent to about 99 percent carbon dioxide.

4. The process of claim 1 wherein the coke is burned from the catalyst in a primary burn wherein the temperature does not exceed about 800° F., and thereafter gradually increasing the amount of oxygen added to the gas to complete the coke burnoff at a temperature not in excess of about 1100° F.

5. The process of claim 4 wherein the temperature of the primary coke burnoff ranges to about 975° F.

6. The process of claim 4 wherein the final temperature of the coke burnoff ranges to about 975° F.

7. The process of claim 1 wherein, after the coke is burned from the catalyst, the catalyst is reactivated and rejuvented by contact with a halogen and oxygen, reduced and then sulfided.

8. The process of claim 1 wherein the reforming unit contains a plurality of on-stream reactors, each containing calyst and connected in series so that hydrogen and naphtha feed flows from one reactor of the series to another to contact the catalyst, and a catalyst-containing swing reactor which, due to an arrangement of process piping and valves comprising headers can be substituted for any one of the on-stream reactors while the latter is off-stream for regeneration and reactivation of the catalyst.

* * * * *

UNITED STATES PATENT OFFICE

CERTIFICATE OF CORRECTION

PATENT NO. : 4,354,925

DATED : October 19, 1982

INVENTOR(S) : James J. Schorfheide

It is certified that error appears in the above-identified patent and that said Letters Patent are hereby corrected as shown below:

| | | |
|---|---|---|
| Column 4, | line 15, | "$NO_2$" should be --$N_2$--. |
| " 5, | line 7, | between "from" and "reactivated," an entire line of Application Serial No. 288,318 (page 6, line 31) has been omitted and should read --from the other reactors of the unit and the catalyst thereof regenerated and reactivated.-- |
| " 5, | line 53, | "represents" should read --presents--. |
| " 7, | line 13, | "10-20 per" should read --10-20 cents per--. |
| " 7, | line 62, | "30° to 300°A" should read --30 to 300 Å--. |
| " 10, | line 7, | "locationn" should read --location--. |
| " 12, (Claim 7) | line 9, | "rejuvented" should read --rejuvenated--. |
| " 12, (Claim 8) | line 13, | "calyst" should read --catalyst--. |

Signed and Sealed this

Twelfth Day of April 1983

[SEAL]

Attest:

GERALD J. MOSSINGHOFF

Attesting Officer

Commissioner of Patents and Trademarks